US009015946B2

(12) United States Patent
Lu

(10) Patent No.: US 9,015,946 B2
(45) Date of Patent: Apr. 28, 2015

(54) METHOD OF FABRICATING A NOZZLE PLATE OF A SPRAY APPARATUS

(75) Inventor: Chun-Fu Lu, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 542 days.

(21) Appl. No.: 12/781,529

(22) Filed: May 17, 2010

(65) Prior Publication Data

US 2010/0224499 A1 Sep. 9, 2010

Related U.S. Application Data

(62) Division of application No. 12/267,727, filed on Nov. 10, 2008, now Pat. No. 7,744,192.

(30) Foreign Application Priority Data

Mar. 25, 2008 (TW) ..... 97110477 A

(51) Int. Cl.
*B41J 2/16* (2006.01)
*B41J 2/135* (2006.01)
(Continued)

(52) U.S. Cl.
CPC *B41J 2/162* (2013.01); *B41J 2/135* (2013.01); *B41J 2/1625* (2013.01); *B41J 2/164* (2013.01);
(Continued)

(58) Field of Classification Search
CPC ..... B41J 2/135; B41J 2/162; B41J 2/1625; B41J 2/164; B41J 2/1643; C25D 1/08; C25D 5/02; C25D 5/022; C25D 5/16; C25D 5/22; B05B 17/0646; B05B 17/0661; Y10T 29/496; Y10T 29/49155; Y10T 29/49128
USPC ..... 29/890.1, 896.6, 846, 831; 205/118, 205/127, 135, 75; 347/44–47
See application file for complete search history.

(56) References Cited

U.S. PATENT DOCUMENTS 4,413,051 A * 11/1983 Thomas ..... 205/135 X
4,675,083 A * 6/1987 Bearss et al. ..... 205/75 X
(Continued)

FOREIGN PATENT DOCUMENTS

JP 01128840 A * 5/1989 ..... 29/890.1
JP 04142939 A * 5/1992 ..... 347/47 X
(Continued)

OTHER PUBLICATIONS

Ohanian, H., "Physics", pp. 202 to 204, 1985.*
(Continued)

*Primary Examiner* — A. Dexter Tugbang
(74) *Attorney, Agent, or Firm* — WPAT, P.C.; Anthony King

(57) ABSTRACT

A method of manufacturing a nozzle plate of a spray apparatus is provided. The method includes providing a conductive layer; forming a plurality of insulating layers on the conductive layer, wherein each of the insulating layers has at least one first tapered geometrical structure with mirror symmetry and a centroid with positional deviation from a first pattern center, and wherein the centroid of the first tapered geometrical structure is a barycenter of the first tapered geometrical structure; forming an electroplating layer on the conductive layer and part of the insulating layer, leaving the central part of the insulating layer exposed; and removing the conductive layer and the insulating layer to form a main body resulting in a plurality of orifices each having an inlet end and an outlet end on the electroplating layer.

12 Claims, 10 Drawing Sheets

(51) Int. Cl.

| | |
|---|---|
| ***C25D 1/08*** | (2006.01) |
| *C25D 5/02* | (2006.01) |
| *C25D 5/16* | (2006.01) |
| *C25D 5/22* | (2006.01) |
| *B05B 17/00* | (2006.01) |
| *B05B 17/06* | (2006.01) |

(52) U.S. Cl.

CPC ..... *B41J 2/1643* (2013.01); *C25D 5/02* (2013.01); *C25D 5/16* (2013.01); *C25D 5/22* (2013.01); *Y10T 29/49401* (2015.01); *Y10T 29/496* (2015.01); *Y10T 29/49155* (2015.01); *Y10T 29/49128* (2015.01); *B05B 17/0646* (2013.01); *B05B 17/0661* (2013.01); *C25D 1/08* (2013.01); *C25D 5/022* (2013.01)

(56) References Cited

U.S. PATENT DOCUMENTS

| | | | | | |
|---|---|---|---|---|---|
| 4,773,971 | A | * | 9/1988 | Lam et al. | 205/75 |
| 5,492,277 | A | | 2/1996 | Tani et al. | |
| 5,560,837 | A | * | 10/1996 | Trueba | 205/127 X |
| 7,040,016 | B2 | | 5/2006 | Bergstrom et al. | |

FOREIGN PATENT DOCUMENTS

| | | | | | |
|---|---|---|---|---|---|
| JP | 2002-115627 | | | 4/2002 | |
| JP | 2002144583 | A | * | 5/2002 | 29/890.1 X |
| TW | 265095 | | | 8/1994 | |
| TW | 290485 | | | 12/1994 | |
| TW | 503129 | | | 9/2002 | |
| TW | 527285 | | | 4/2003 | |

OTHER PUBLICATIONS

Machine Language Translation of Japanese Patent Publication, JP 2002-144583.*

Search Report dated Aug. 11, 2010 for 200810086984.4, which is a corresponding Chinese application, that cites TW290485B and TW265095B.

Taiwanese Office Action dated Dec. 24, 2010 for 097110477, which is a corresponding Taiwanese application, that cites US5492277, US7040016, TW503129, TW527285, and JP2002-115627A.

* cited by examiner

METHOD OF FABRICATING A NOZZLE PLATE OF A SPRAY APPARATUS

CROSS-REFERENCE TO RELATED APPLICATIONS

This application is a Divisional of U.S. patent application Ser. No. 12/267,727, which is also U.S. Pat. No. 7,744,192, filed on Nov. 10, 2008, which claims foreign priority TW 097110477 filed on Mar. 25, 2008, all of which is hereby incorporated by reference in its entirety.

Although incorporated by reference in its entirety, no arguments or disclaimers made in the parent application apply to this divisional application. Any disclaimer that may have occurred during the prosecution of the above-referenced application(s) is hereby expressly rescinded. Consequently, the Patent Office is asked to review the new set of claims in view of the entire prior art of record and any search that the Office deems appropriate.

BACKGROUND OF THE INVENTION

1. Field of the Invention

The present invention relates to a liquid nebulizing (atomizing) technique, and more particularly, to a nozzle plate of a spray apparatus and its manufacturing method.

2. Description of Related Art

Liquid nebulizing systems have become more widely adopted in various applications such as drug delivery systems in the biomedical field, atomizing fuel for internal combustion engines in the automotive field as well as the heat radiation using liquid exchange in the HVAC field. All of the foregoing applications employ nebulization theory and examples of relevant patents include U.S. Pat. Nos. 4,465,234, 4,605,167, 6,089,698, 6,235,177 and 6,629,646, Taiwanese Patent Numbers 407529, 449486, 503129, 506855 and 562704, as well as the Taiwanese Patent Cert. Number 1222899.

Most of the conventional designs for the nozzle plate of the spray apparatus employ a piezoelectric actuator as a vibrator with a matched nozzle plate 20 having a plurality of orifices 201 as illustrated in FIGS. 8A and 8B, thereby allowing a nozzle plate 20 to come into immediate contact with a liquid 21 to be nebulized. Electrical voltage is applied to the piezoelectric actuator to vibrate liquid 21 in a holding reservoir and spray the liquid 21, such that the liquid 21 departs from the nozzle plate 20 through these orifices 201, thereby creating a fine mist. However, in that the design of the conventional nozzle plate 20 is a geometric structure with mirror symmetry, the liquid 21 in the device is ejected in a direction perpendicular to the exterior surface of the nozzle plate 20 (as shown in FIG. 8B) such that coverage of mist ejection is subject to position and size of the orifices 201 of the nozzle plate 20, thus resulting in a narrow nebulizing range that leads to accumulation of the nebulized droplets due to collisions. This not only increases the size of the nebulized droplets but also diminishes the nebulizing effect. Also, if the coverage of nebulization is to be increased, the number of orifices or the driving frequency of the piezoelectric actuator must be increased, or both, thereby increasing system volume, not to mention that a large driving area requires a higher resonance mode. As a consequence, both liquid and energy consumption will be increased.

U.S. Pat. No. 4,465,234 discloses an application of a semicircular nozzle plate on a spray apparatus that changes the geometric shape of the nozzle plate so as to increase the nebulizing area. The nozzle plate of the spray apparatus includes a nozzle plate having a cavity for containing a liquid, a nozzle installed on the nozzle plate and communicating with the cavity, a piezoelectrically actuated vibrator installed on the nozzle plate and configured to pressurize the liquid cyclically, filling means for filling and maintaining the liquid in the cavity, electric means for supplying an alternating voltage to the piezoelectric actuator to drive vibration, and means operatively coupled with the filling means for delivering the liquid. When the liquid in the cavity is pressurized, the liquid is sprayed in the form of a mist, and, because the design adopts a nozzle plate having an arc-shaped nozzle, the mist range increases.

U.S. Pat. No. 4,605,167 proposes an ultrasonic application of a nozzle plate of a spray apparatus. Such an application of the nozzle plate of the spray apparatus increases the mist range by expanding the spraying range of the orifices. Even though such a conventional technique increases the mist range, the larger spraying range of the orifices requires a higher operating frequency for the piezoelectric actuator, and, therefore, the energy consumed by driving the spray apparatus is also increased, leading to the disadvantage of excessive spray apparatus volume, which poses a problem of accumulation of the nebulized droplets.

U.S. Pat. No. 6,089,698 proposes a method and a device for forming a nozzle. The method comprises directing a high-energy laser beam towards a face of a nozzle plate so as to form a nozzle bore in the nozzle plate, thereby controlling the ejecting direction for the expelled droplets. Also, Japan Patent Number 2002-115627 proposes a two-step process for forming orifices on the nozzle plate surface, thereby controlling the ejection direction of the liquid droplets. However, the laser process is a technique that is unable to easily control the droplet propagation direction and the Japanese method is complicated, and thus the problems of a narrow nebulization range as well as ineffective nebulization are still not solved.

U.S. Pat. No. 6,235,177 discloses an application for manufacturing a nozzle plate of a spray apparatus. By forming aperture orifices on the top and bottom surfaces, the liquid droplets are ejected at a high speed along the axes of the orifices. In the U.S. Pat. No. 7,040,016, the orifices formed by the etching process are symmetrical with respect to the axis. However, the aforementioned conventional technique creates a symmetrical design for the orifices employed by the nozzle plate of the spray apparatus, but employing such a technique will limit perpendicular propagation of the liquid droplets, and the mist area is still limited by the position of the orifice openings as well as the size of the openings. As such, disadvantages in the above-mentioned patents still exist involving ineffective nebulization.

Based on the above explanations, the conventional liquid nebulization techniques cause the problems of nebulization failure, limitation of the nebulizing area by the opening size, droplet accumulation due to spraying by concentrated orifices, over-sized spray apparatus, and complicated manufacturing processes for the nozzle plate, thereby leading to ineffective nebulization, a waste of resources, difficulties in product miniaturization and disadvantages in manufacture.

Hence, it has become an urgent issue to designers of the nozzle plate of the spray apparatus to propose a technique that overcomes the foregoing difficulties.

SUMMARY OF THE INVENTION

In light of the disadvantages of the prior art, an objective of the present invention is to provide a nozzle plate and manufacturing method for a spray apparatus that enlarges the nebulizing area.

Another objective of the present invention is to provide a nozzle plate and manufacturing method for a spray apparatus that gives a well-mixed nebulizing liquid.

Yet another objective of the present invention is to provide a nozzle plate and manufacturing method for a spray apparatus that miniaturizes the product.

A further objective of the present invention is to provide a nozzle plate and manufacturing method for a spray apparatus that does not require extra energy consumption.

The present invention discloses a nozzle plate of a spray apparatus and a manufacturing method thereof comprising: providing a conductive layer; forming a plurality of insulating layers on the conductive layer, wherein the shape of the insulating layers is shaped into mirroring symmetrical geometrical structures with a centroid characterized by positional deviation from the center of an imaginary circle circumscribed about a corresponding one of the geometrical structures; forming an electroplated layer on part of the conductive layer that overlaps onto part of the insulating layer, but leaves the central portion of the insulating layer exposed; and removing both the conductive layer and the insulating layer to form a nozzle plate; and forming in the nozzle plate a plurality of orifices each having an inlet end and an outlet end formed in the electroplating layer. In addition the inlet end and the outlet end are mirroring symmetrical with a centroid characterized by positional deviation from a pattern center, wherein the pattern center is the center of an imaginary circle circumscribed about the mirroring symmetrical geometrical structure, and the centroid is the barycenter (center of mass) of the mirroring symmetrical geometrical structure. The mirroring symmetrical geometrical structure is tapered and comes in different shapes, such as an isosceles triangle, a drop-shape, or a heart.

The present invention discloses a nozzle plate of a spray apparatus including a main body having a plurality of orifices with each orifice having an inlet end for liquid to enter and an outlet end for liquid to depart, wherein the inlet end and the outlet end have a geometrical structure with mirror symmetry and have a centroid characterized by positional deviation from a pattern center. The pattern center is the center of an imaginary circle circumscribed about the mirroring symmetrical geometrical structure. The mirroring symmetrical geometrical structure is tapered, comes in different shapes, such as an isosceles triangle, a drop-shape, or a heart, and is configured to control the angle at which the liquid departs as well as the direction in which the liquid is propagated.

The main body of the nozzle plate is coupled to an actuator mounted to the main body with the actuator on the side with a liquid container so as to provide nebulization of the liquid placed in the liquid container. The inlet end and the outlet end of the nozzle of the main body are mirroring symmetrical and have a centroid with positional deviation from a pattern center so as to control the predetermined angle at which the liquid departs as well as the direction in which the liquid is propagated. Also, the geometry of the orifice design as well as the coordination of the overall orifice arrangement distribution are varied in accordance with the user's requirements, thereby allowing the liquid to be nebulized in the same direction at different angles of slanting, concentration or scattering so as to achieve the effect of enlarging the nebulizing area and obtain a more uniformly distributed nebulizing of the liquid. At the same time, varying the arrangement of the orifice distribution lowers the number of mutual collisions between nebulized liquid droplets without increasing the volume of the spray apparatus and consuming additional energy. Moreover, a plurality of grooves arranged in an array are formed on the main body to provide the nozzle plate with a draining function, thereby avoiding problems such as accumulation of nebulized liquid and an increase of the volume.

The nozzle plate of the spray apparatus and its manufacturing method according to the present invention involve primarily forming a plurality of orifices having an inlet end and an outlet end, wherein the inlet end and the outlet end are mirroring symmetrical and have a centroid characterized by positional deviation from a pattern center. An example of the mirroring symmetrical geometrical structure is a tapered structure such as an isosceles triangle, a drop-shape, or a heart. The geometry structure of the outlet end of the nozzle plate controls the propagation direction of liquid nebulization, thereby achieving the effect of enlarging the nebulizing area with the same orifice distribution area and miniaturizing the product without consuming additional energy, which is advantageous to saving resources.

DETAILED DESCRIPTION OF PREFERRED EMBODIMENTS

The following illustrative embodiments are provided to illustrate the disclosure of the present invention; these and other advantages and effects can be readily understood by those skilled in the art after reading the disclosure of this specification. The present invention can also be performed or applied by other differing embodiments. The details of the specification may be changed on the basis of different points and applications, and numerous modifications and variations can be devised without departing from the spirit of the present invention.

First Embodiment

FIGS. 1A to 1G are diagrams depicting a main body of a nozzle plate of the present invention and the manufacturing method as well as illustrating an application of the nozzle plate on a spray apparatus according to the first embodiment. The nozzle plate of the present invention forms a spray apparatus in conjunction with an actuator 120, such as a piezoelectric actuator, and a liquid container 130. The nozzle plate is installed on one side of the liquid container 130, which is for containing a liquid 140 to be nebulized. The combination of the actuator 120 and the nozzle plate nebulizes the liquid 140 by vibrating the nozzle plate.

Figure 1A:
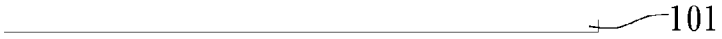
FIGS. 1A, 1B, and 1D to 1F are schematic views of a first embodiment of the main body of a nozzle plate and its manufacturing method according to the present invention.
Figure 1B:
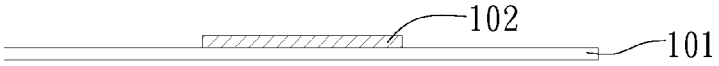
Figure 1C:
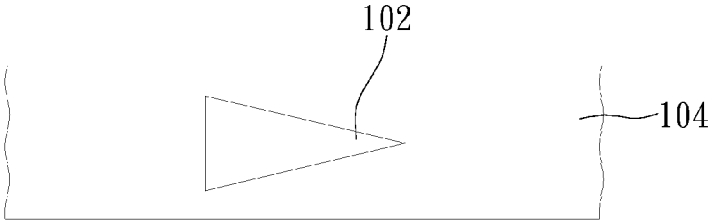
FIG. 1C is a front view of the conductive layer of FIG. 1B.

As shown in FIGS. 1A to 1C, an electrically conductive layer 101 is provided. A plurality of insulating layers 102 (only one is shown) is formed on the conductive layer 101. Subsequently, a pattern is defined on the insulating layer 102 by a photolithography process or a printing process, shaping the insulating layer 102 into a mirroring symmetrical geometrical structure with a centroid characterized by positional deviation from a pattern center. The pattern center is the center of a circle circumscribed about the mirroring symmetrical geometrical structure. The centroid is the barycenter (center of mass) of the mirroring symmetrical geometrical structure. In other words, the insulating layer 102 is shaped into a tapered structure such as isosceles triangle, drop-shape, or heart.

Figure 1D:
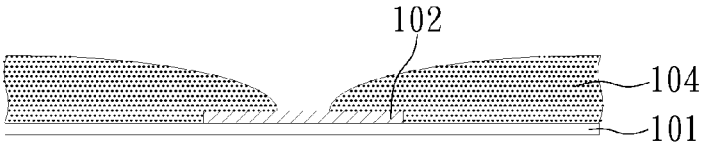
Figure 1E:
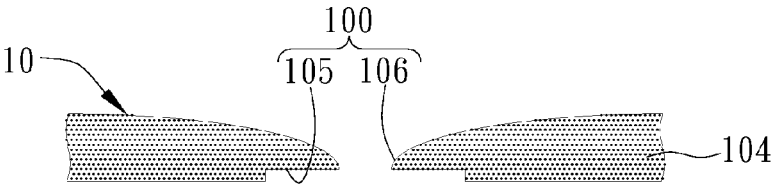

As illustrated in FIGS. 1C to 1D, in an electroplating process, an electroplating layer 104 is formed on top of the conductive layer 101 and part of the insulating layer 102, leaving the inner part of the insulating layer 102 exposed. Subsequently, the conductive layer 101 and the insulating layer 102 are removed, thus forming a plurality of orifices 100 each having an inlet end 105 and an outlet end 106. The paired inlet end 105 and outlet end 106 are mirroring symmetrical and have a centroid with positional deviation from a pattern center. With the electroplating process, an electroplating layer 104 is formed on top of the conductive layer 101 and part of the insulating layer 102, using electroplating solutions, such as nickel sulfamate having a 1:1 ratio of lateral growth and vertical growth. However, the ratio of the lateral growth to the vertical growth varies with the types of the additive agents added to the electroplating solution.

Figure 1F:
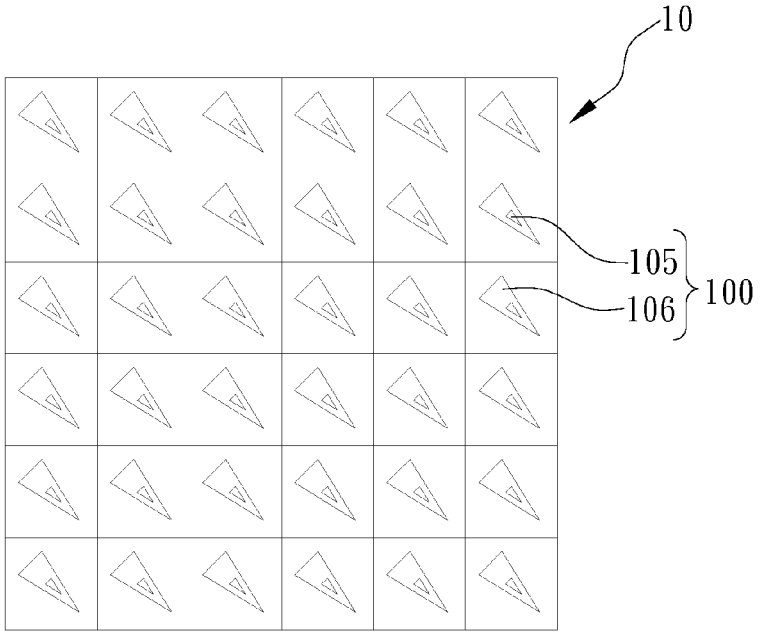
Figure 1G:
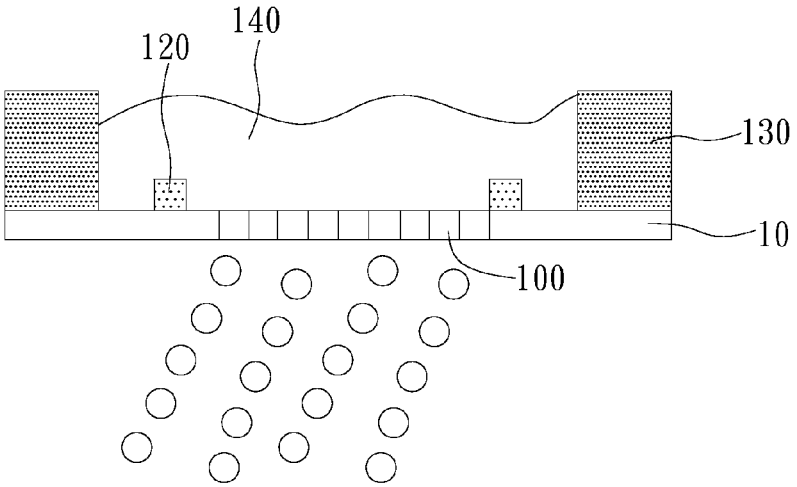
FIG. 1G is a schematic view of an embodiment of the nozzle plate of a spray apparatus in FIG. 1F of the present invention.

FIGS. 1F and 1G illustrate the main body 10 of the nozzle plate having a plurality of orifices 100 according to the above-described procedure, wherein the orifices 100 are arranged, for example, in either array distribution with rows and columns or ring distribution in concentric tracks. The paired inlet end 105 and outlet end 106 of each of the orifices 100 are mirroring symmetrical and have a centroid with positional deviation from a pattern center. In other words, the paired inlet end 105 and outlet end 106 have a tapered geometrical structure, such as isosceles triangle, drop-shape, or heart. The main body 10 of the nozzle plate is coupled to the actuator 120, and is sideways provided with a liquid container 130 for containing the liquid 140 to be nebulized.

According to the present embodiment, the actuator 120, which is a piezoelectric ring, a piezoelectric plate, or a piezoelectric block, is made of piezoelectric materials such as lead zirconate titanate solid solution. In that piezoelectric material has the mechanical-to-electrical or electrical-to-mechanical converting ability and has other useful properties such as being light weight, small, and quick responding and also possesses a high phase shift output when driven by a low input voltage, such a material is therefore quite suitable for making the actuator. The actuator 120 creates oscillating energy due to the piezoelectric effect, allowing the nozzle plate of the combination to vibrate to drive nebulizing of the liquid by breaking it up into fine droplets. In addition, the orifices 100 are formed at the area of contact between the main body 10 of the nozzle plate and the actuator 120 (or in the surrounding area). In other words, the orifices 100 are distributed on the piezoelectric plate bonding area and a body bonding area such that the bonding effect of the main body 10 of the nozzle plate and the actuator 120 is strengthened by a grooved structure. The main body 10 of the nozzle plate is an electroformed body, an etched body, a laser-cut body, a metallic body, or a non-metallic body.

In summary, the present invention discloses a nozzle plate of a spray apparatus including: a main body 10 having a plurality of orifices 100, wherein each of the orifices 100 has an inlet end 105 for the liquid 140 to enter and an outlet end 106 for the liquid 140 to exit. The paired inlet end 105 and outlet end 106 have a geometrical structure with mirror symmetry and have a centroid characterized by positional deviation from a pattern center. The mirroring symmetrical geometrical structure is tapered, comes in different shapes, such as an isosceles triangle, a drop-shape, or a heart, and is configured to control the predetermined angle at which the liquid departs as well as the direction in which the liquid is expelled at that angle.

Figure 2A:
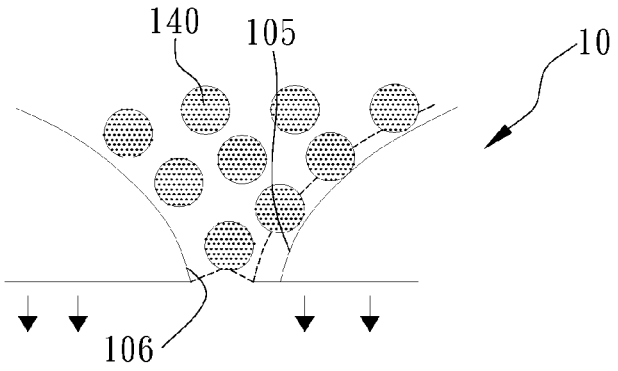
FIGS. 2A to 2C are schematic views showing the propagation direction in which liquid departs from the nozzle plate of the spray apparatus according to the present invention.
Figure 2B:
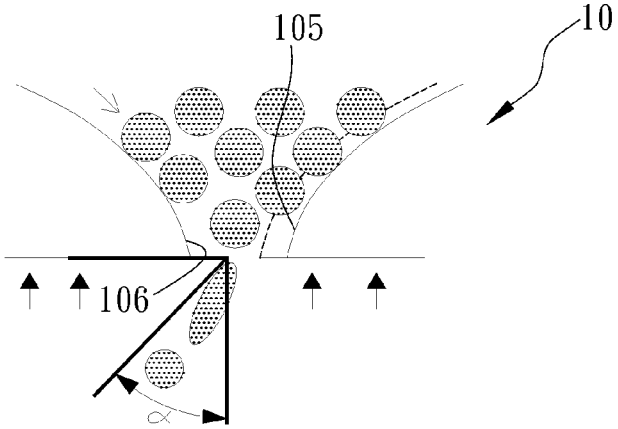
Figure 2C:
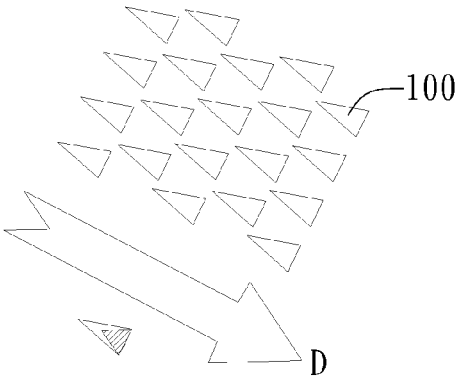
Figure 3A:
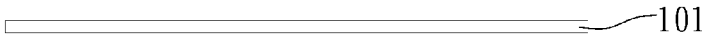
FIGS. 3A, 3B, and 3D to 3E are schematic views of a second embodiment of the nozzle plate of the spray apparatus and its manufacturing method according to the present invention.
Figure 3B:
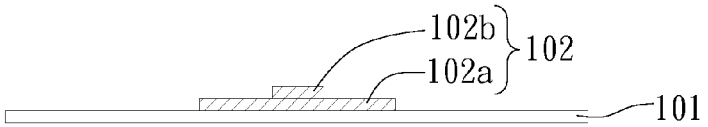
Figure 3C:
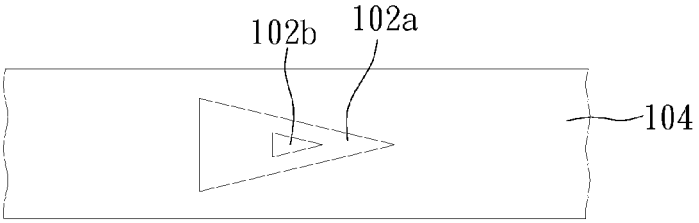
FIG. 3C is a front view of the conductive layer of FIG. 3B.
Figure 3D:
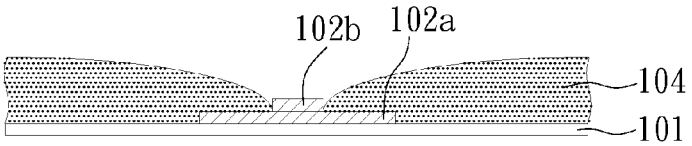
Figure 3E:
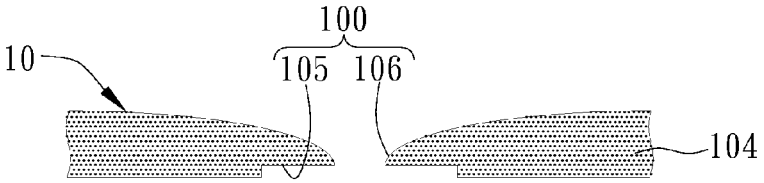

FIGS. 2A to 2C are diagrams illustrating the propagation direction in which the liquid departs from a nozzle of the spray apparatus of the present invention. As shown in the diagram, according to the present embodiment, the mirroring symmetrical geometrical structure is an isosceles triangle. When the liquid 140 to be nebulized is placed in the liquid container, the piezoelectric property of the actuator 120 then allows the main body 10 of the nozzle plate to vibrate and drive nebulization of the liquid 140, and drive the liquid 140 out of the outlet end 106 at a slanting angle $\alpha$. The slanting angle $\alpha$ is calculated relative to the liquid droplet center and the axial center of the orifice. The slanting angle $\alpha$ is 45 or 60 degrees. Also, as the paired inlet end 105 and outlet end 106 have a geometrical structure with mirror symmetry and a centroid with positional deviation from a pattern center, the liquid 140 is propagated in direction D, resulting in displacement of the liquid 140 towards the base of the isosceles triangle. The displacement angle is adjustable during the design process according to the base-to-leg length ratio of the isosceles triangle; in other words, the greater the height of the isosceles triangle (i.e., the more tapered), the larger the displacement angle. As such, the main body 10 of the nozzle plate enlarges the nebulizing range of the liquid 140, and, at the same time, the geometrical structure of the inlet end 105 and the outlet end 106 controls the propagation direction of the nebulized liquid.

Second Embodiment

Referring to FIGS. 3A to 3E, a second embodiment of a nozzle plate of a spray apparatus and its manufacturing method according to the present invention are illustrated. The second embodiment of the present invention is generally the same as the above-described first embodiment. The primary difference is that an insulating layer 102 further includes a first insulating layer 102*a* and a second insulating layer 102*b*. In other words, a plurality of the first insulating layers 102*a* is formed on a conductive layer 101, and a plurality of second insulating layers 102*b* with areas smaller than that of the first insulating layers 102*a* is respectively formed on top of the first insulating layers 102*a*. At the same time, a pattern is defined on the first insulating layer 102*a* and the second insulating layer 102*b* by a photolithography process or a printing process, allowing the first insulating layers 102*a* and the second insulating layers 102*b* to form mirroring symmetrical geometrical structures with a centroid characterized by positional deviation from a pattern center. Subsequently, the electroplating process covers the conductive layer 101 and the first insulating layer 102*a* with an electroplating layer 104, while leaving the second insulating layer 102*b* exposed.

Next, the conductive layer 101, the first insulating layer 102*a* and the second insulating layer 102*b* are removed, forming a plurality of orifices 100 having an inlet end 105 and an outlet end 106 on the electroplating layer. The paired inlet end 105 and outlet end 106 are mirroring symmetrical and have a centroid with positional deviation from a pattern center.

Third Embodiment

Figure 4A:
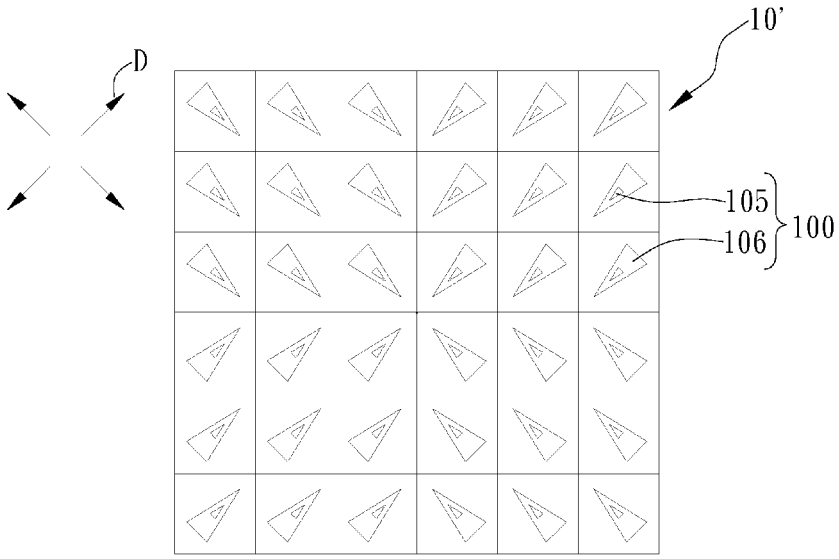
FIGS. 4A and 4B are schematic views of a third embodiment of the nozzle plate of the spray apparatus according to the present invention.
Figure 4B:
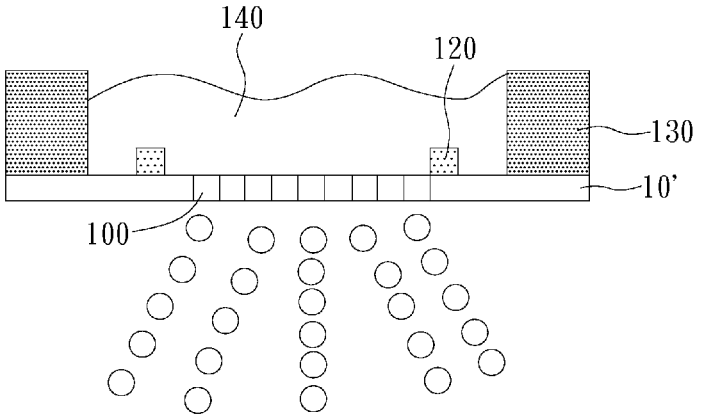

FIGS. 4A and 4B show a third embodiment of a nozzle plate of a spray apparatus of the present invention. As shown in the diagrams, the third embodiment is generally the same as the above-described first embodiment. The primary difference is that the tapered ends of the inlet ends 105 and the outlet ends 106 face the interior of the main body 10', displacing the propagation direction D of the liquid 140 toward the base of the geometrical structure so as to control the propagation direction D of the nebulization of the liquid 140 such that the ejected liquid is scattered, thereby expanding the range of liquid nebulization.

Fourth Embodiment

Figure 5A:
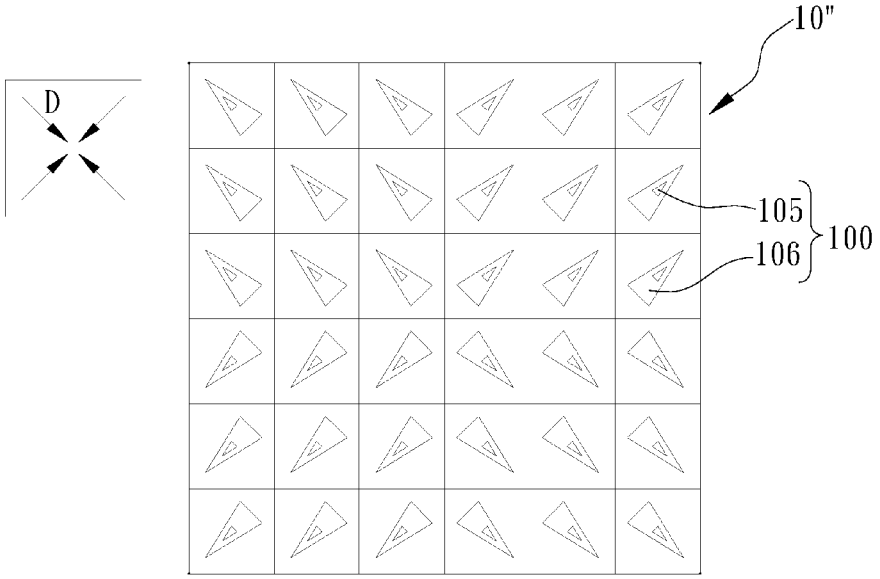
FIGS. 5A and 5B are schematic views of a fourth embodiment of the nozzle plate of the spray apparatus according to the present invention.
Figure 5B:
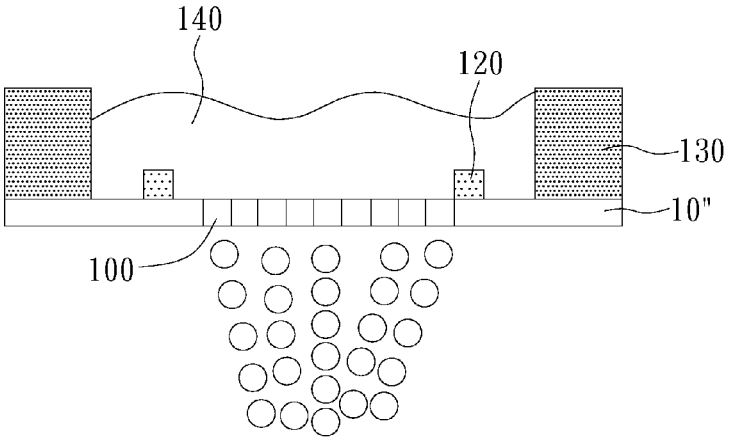

FIGS. 5A and 5B illustrate a fourth embodiment of a nozzle plate of a spray apparatus according to the present invention. As shown in the diagrams, the fourth embodiment is generally the same as the above-described first embodiment. The primary difference is that the tapered end of the inlet ends 105 and the outlet ends 106 face the exterior of a main body 10", displacing the propagation direction D of the liquid 140 toward the base of the geometrical structure so as to control the propagation direction D of the nebulization of the liquid 140 such that the range of the liquid nebulization is kept within a specified angle.

Fifth Embodiment

FIGS. 6A to 6E show a fifth embodiment of a nozzle plate of a spray apparatus of the present invention. In the figures, the fifth embodiment of the present invention is generally the same as the above-described first embodiment. The primary difference is that a plurality of grooves 110 are formed on a main body 10''' of the nozzle plate to provide the nozzle plate with a draining function.

Figure 6A:
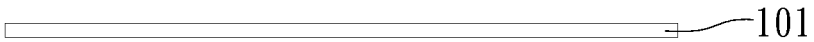
FIGS. 6A to 6E are schematic views of a fifth embodiment of the nozzle plate of the spray apparatus according to the present invention.
Figure 6B:
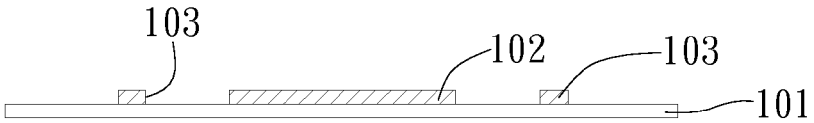

As depicted in FIGS. 6A and 6B, a conductive layer 101 is provided. A plurality of insulating layers 102 is formed on the conductive layer 101, and a plurality of third insulating layers 103 is formed on the conductive layer 101 near the periphery of the insulating layer 102. At the same time, a pattern is defined on the insulating layers 102 by a photolithography process or a printing process, shaping the insulating layers 102 into mirroring symmetrical geometrical structures. Each of the mirroring symmetrical geometrical structures has a centroid with positional deviation from a pattern center. The pattern center is the center of an imaginary circle circumscribed about the corresponding one of the mirroring symmetrical geometrical structures. The centroid is the barycenter (center of mass) of the corresponding one of the mirroring symmetrical geometrical structures. In other words, the insulating layers 102 are shaped into tapered structures, such as an isosceles triangle, a drop-shape, or a heart.

Figure 6C:
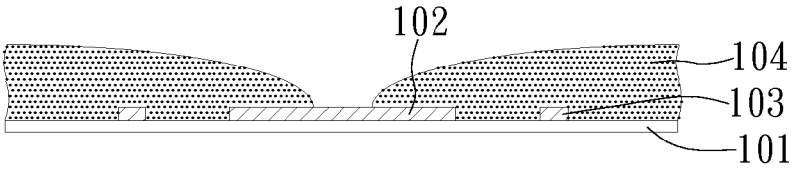
Figure 6D:
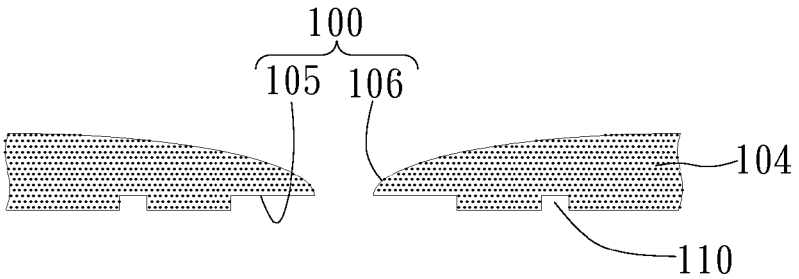

As shown in FIGS. 6C and 6D, the electroplating process forms an electroplating layer 104 on top of the conductive layer 101 and the plurality of third insulating layers 103, and it partially covers each of the insulating layers 102, leaving parts of the insulating layers 102 exposed. Subsequently, the conductive layer 101, the insulating layer 102 and the third insulating layer 103 are removed to form a plurality of orifices 100 having an inlet end 105 and an outlet end 106 on the electroplating layer. The removal step also forms a plurality of grooves 110 on the electroplating layer 104, wherein the grooves are arranged in an array distribution. For the orifices, each inlet end 105 and each outlet end 106 have a centroid deviating from the pattern center and a geometrical structure with minor symmetry.

Figure 6E:
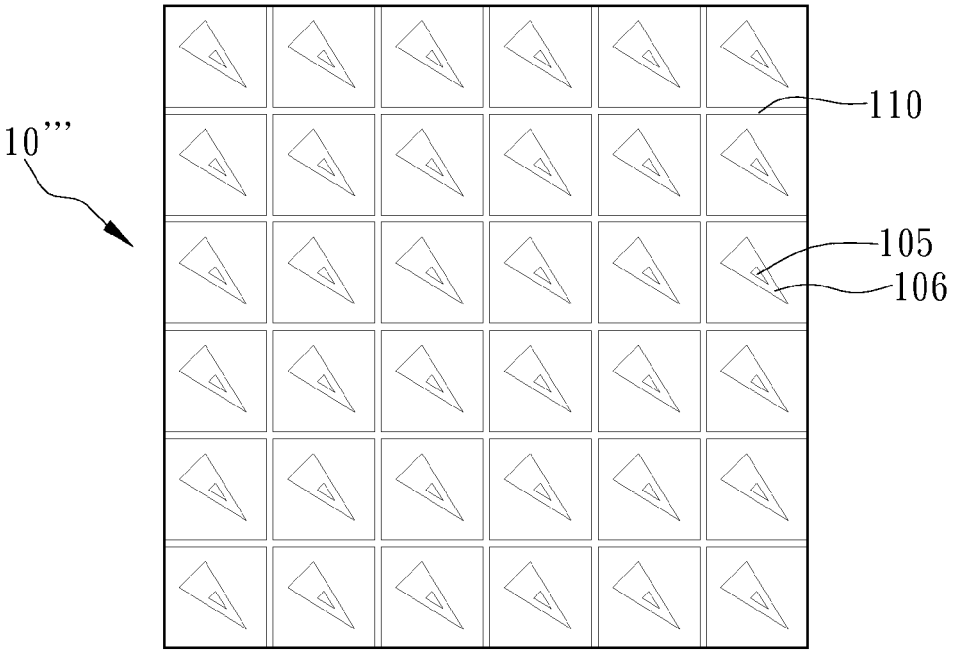

As depicted in FIG. 6E, the above-described procedure forms the main body 10''' of the nozzle plate having a plurality of orifices 100 arranged in an array distribution. In addition, the paired inlet end 105 and outlet end 106 of each of the orifices 100 have a centroid with positional deviation from the pattern center and a geometrical structure with mirror symmetry.

The main body 10''' of the nozzle plate is coupled to the actuator, whose main body is installed on the side with the liquid container for nebulizing the liquid held in the liquid container. Each of the inlet ends 105 and the outlet ends 106 of the nozzles 100 of the main body 10''' has a centroid with positional deviation from the pattern center and has minor symmetry so as to select a predetermined angle at which the liquid departs as well as the direction in which the liquid is propagated. The liquid is nebulized at different angles of slanting, or concentrated or scattered in accordance with the user's requirements so as to effectively control the nebulizing range. At the same time, the grooves 110 arranged in an array distribution are formed on the main body 10''' so as to provide the nozzle plate with a draining function, thereby avoiding problems such as accumulation of nebulized liquid and an increase of the volume.

Figure 7A:
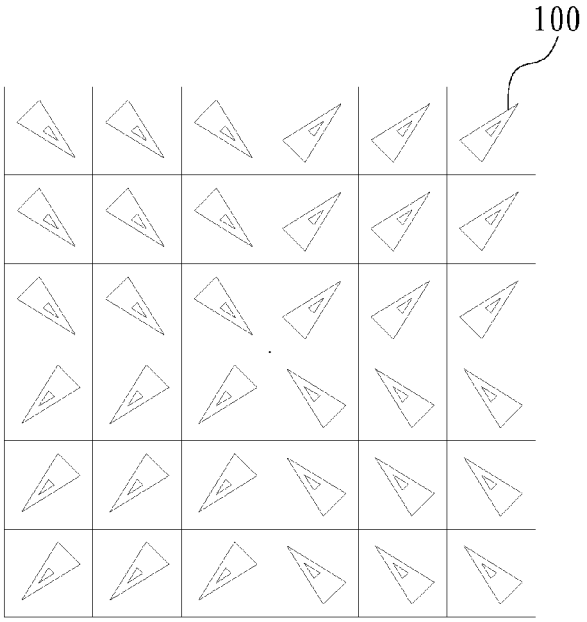
FIGS. 7A and 7B are schematic views of other embodiments of the nozzle plate of the spray apparatus according to the present invention.
Figure 7B:
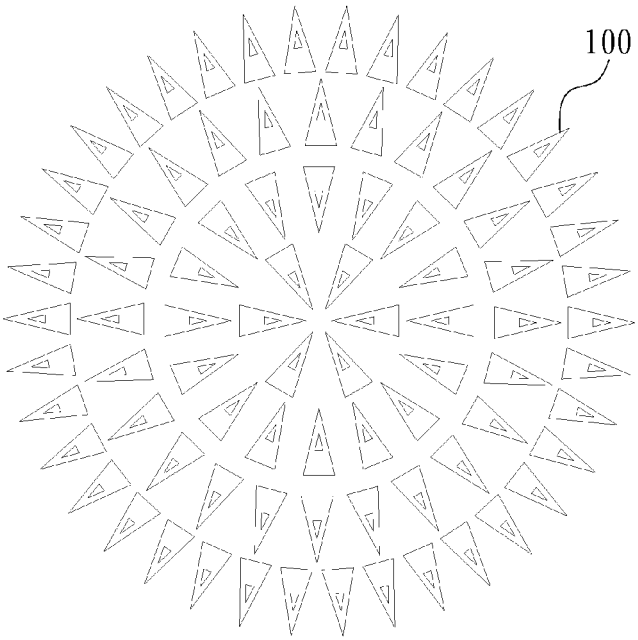
Figure 8A:
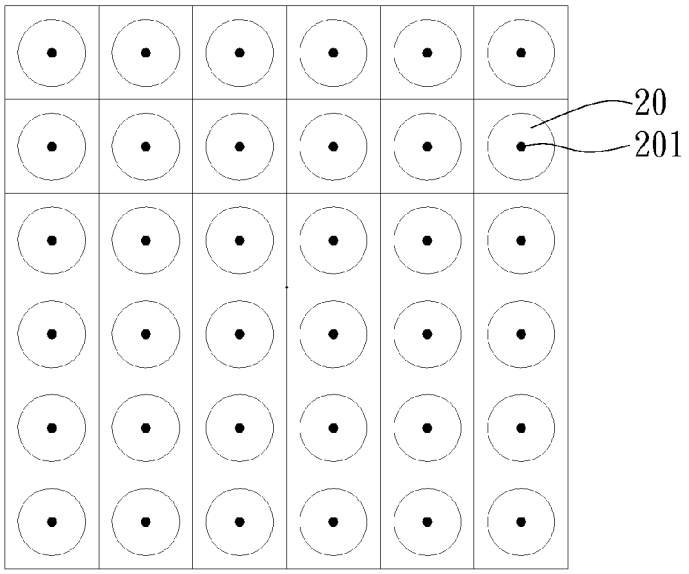
FIG. 8A (PRIOR ART)
FIGS. 8A and 8B (PRIOR ART) are schematic views illustrating the propagation direction in which the liquid departs from the conventional nozzle plate of a spray apparatus.
Figure 8B:
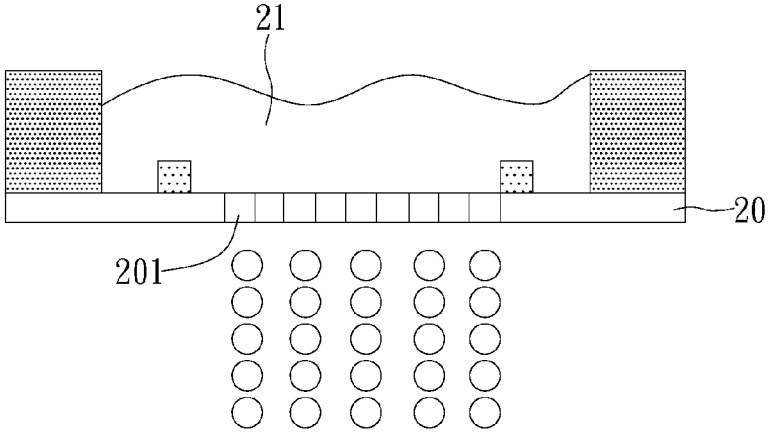
FIG. 8B (PRIOR ART)

It is to be noted that the tapered structures of the above-mentioned embodiments face the interior of the main body, the exterior of the main body, or both. However, the present invention is not bound by the above limitation, and persons skilled in the art can further change the nebulizing area according to actual requirements. As illustrated in FIGS. 7A and 7B, the tapered ends of some of the orifices 100 of the nozzle plate face the interior of the main body, whereas the tapered ends of other orifices 100 face the exterior of the main body so as to provide multiple angles at which the liquid is ejected to achieve the effect of enlarging the nebulizing area and obtaining a more evenly distributed nebulized liquid. At the same time, by changing the distribution or direction of the disposed orifices, collisions between nebulized liquid droplets are lowered without requiring an increase in the volume or energy consumed.

In addition, according to the above-mentioned embodiment, the outlet end surface of the orifices of the nozzle plate can be coated with a moisture-resistant material to avoid accumulation of nebulized liquid droplets on the orifices of the nozzle plate.

The nozzle plate of the spray apparatus according to the present invention and its manufacturing method involve forming a plurality of orifices each having an inlet end and an outlet end on the nozzle plate, wherein each pair of inlet ends and outlet ends of the orifices have a centroid with positional deviation from a pattern center and have a geometrical structure with mirror symmetry, such as an isosceles triangle, a drop-shape, a heart, or other tapered structures. A combination of the nozzle plate and an actuator is installed on the same side of the nozzle plate as the liquid container so that when liquid to be nebulized is placed in the liquid container, the piezoelectric property of the actuator then allows the main body of the nozzle plate to vibrate and drive nebulization of the liquid. As a consequence, the liquid is forced to depart from the outlet end of the nozzle plate at a slanting angle $\alpha$. Also, as each pair of inlet ends and outlet ends is mirroring symmetrical and has a centroid with positional deviation from the pattern center, the geometrical structure of the outlet ends 106 serves to control the propagation direction of the nebulized liquid.

In comparison with the prior art, the present invention enables changes in the design of the geometry of orifices and the overall orifice distribution so as to expand the nebulizing range per unit density of orifices, and in consequence the products are downsized, consume no additional energy, but save energy. The propagation direction of liquid nebulization is controlled by the geometrical structure of the orifices, and the distribution of the potentially multiple directions of the orifices is changed according to the user's requirement, thereby nebulizing the liquid at different angles of slanting, concentrating or scattering to effectively control the nebulizing range and lower the number of collisions between nebulized liquid droplets without requiring additional apparatus volume as well as energy consumption, thus solving existing problems of the prior art.

The foregoing embodiments and advantages are merely exemplary and are not to be construed as limiting the present invention. It will be understood that variations and modifications can be effected thereto by those skilled in the art without departing from the spirit and scope of the invention as defined by the appended claims.

What is claimed is:

1. A method of manufacturing a nozzle plate of a spray apparatus, comprising the steps of:

providing a conductive layer;

forming a plurality of insulating layers on the conductive layer, wherein each of the insulating layers has at least one first planar-tapered geometrical structure with mirror symmetry and a centroid with positional deviation from a first pattern center, wherein the centroid of the first planar-tapered geometrical structure is a barycenter (center of mass) of the first planar-tapered geometrical structure, and the first pattern center is a center of a circle circumscribed about the first planar-tapered geometrical structure;

forming an electroplating layer on the conductive layer and part of insulating layers, leaving the central part of insulating layers exposed; and removing the conductive layer and the insulating layers to form a main body resulting in a plurality of orifices each having an inlet end and an outlet end on the electroplating layer, wherein the inlet end and the outlet end are triangular on surfaces of the electroplating layer and the paired inlet end and outlet end have a second geometrical structure with mirror symmetry; and wherein a second pattern center of the second geometrical structure is a center of a circle circumscribed about the second geometrical structure.

2. The method of manufacturing a nozzle plate of a spray apparatus of claim 1, in which the main body forms a plurality of grooves on the outlet side of the electroplating layer, and the plurality of insulating layers formed on the conductive layer comprises a plurality of the first insulating layers for forming the orifices and a plurality of second insulating layers for forming the grooves, wherein the electroplating process is used to coat the conductive layer with the electroplating layer, thereby partially coating each of the first insulating layers and completely coating each of the second insulating layers with the electroplating layer.

3. The method of manufacturing a nozzle plate of a spray apparatus of claim 2, wherein the grooves are arranged in an array distribution.

4. The method of manufacturing a nozzle plate of a spray apparatus of claim 1, wherein the orifices are arranged in one of an array distribution and a ring distribution.

5. The method of manufacturing a nozzle plate of a spray apparatus of claim 1, wherein the geometrical structure of the orifices is tapered.

6. The method of manufacturing a nozzle plate of a spray apparatus of claim 5, wherein the tapered end of the geometrical structure of the orifices points inward.

7. The method of manufacturing a nozzle plate of a spray apparatus of claim 5, wherein the tapered end of the geometrical structure of the orifices points outward.

8. The method of manufacturing a nozzle plate of a spray apparatus of claim 1 further comprising the step of coupling the main body to an actuator for driving a liquid into the inlet end for nebulization, the actuator being a piezoelectric actuator.

9. The method of manufacturing a nozzle plate of a spray apparatus of claim 8, wherein the piezoelectric actuator is one selected from the group consisting of a piezoelectric ring, a piezoelectric plate, and a piezoelectric block.

10. The method of manufacturing a nozzle plate of a spray apparatus of claim 8, wherein a plurality of orifices are formed at an area of contact between the actuator and the main body.

11. The method of manufacturing a nozzle plate of a spray apparatus of claim 1 further comprising the step of coating the outlet end with an anti-wetting material.

12. The method of manufacturing a nozzle plate of a spray apparatus of claim 1, wherein the insulating layers are formed on the conductive layer by one of a photolithography process and a printing process.

* * * * *